United States Patent [19]

Lamothe

[11] 4,117,643

[45] Oct. 3, 1978

[54] ANCHOR BOLT THREAD PROTECTOR AND SLEEVE SYSTEM

[76] Inventor: Surguies M. Lamothe, 1813 Feronia St., Metarie, La. 70005

[21] Appl. No.: 770,283

[22] Filed: Feb. 22, 1977

[51] Int. Cl.[2] ..... E04B 1/41; E04C 5/07; F16B 35/00; F16B 37/00

[52] U.S. Cl. ..... 52/699; 85/9 R; 85/32 K; 151/19 R; 29/264; 52/704; 85/1 R

[58] Field of Search ..... 85/1 R, 9, 32 K; 151/19 R; 29/264; 52/99, 219, 619, 704–708, 711, 699; 403/3, 307

[56] References Cited

U.S. PATENT DOCUMENTS

| | | | |
|---|---|---|---|
| 937,577 | 10/1909 | Crump | 85/1 R |
| 991,517 | 5/1911 | Kennedy | 52/704 |
| 1,539,513 | 5/1925 | Ross | 151/19 R |
| 2,927,807 | 3/1960 | Campbell | 151/19 R |
| 3,807,110 | 4/1974 | Kaminski | 52/219 |
| 3,854,371 | 12/1974 | Lamothe | 52/699 |
| 3,867,804 | 2/1975 | Wilson | 52/99 |

FOREIGN PATENT DOCUMENTS

| | | | |
|---|---|---|---|
| 586,917 | 4/1925 | France | 29/264 |
| 813,643 | 3/1937 | France | 85/1 R |

*Primary Examiner*—James L. Ridgill, Jr.
*Attorney, Agent, or Firm*—John F. Sieberth

[57] ABSTRACT

The system is composed of a sleeve to form a void space around a segment of the length of an anchor bolt; a hollow, cylindrical connecting member detachably attachable to the upper end of the sleeve and having a portion that is radially inwardly deformable; and a fastening member having a hollow, cylindrical interior adapted to fit around and engage the connecting member to cause its radially inwardly deformable portion to deform inwardly to cause gripping engagement between a portion of the interior of the connecting member and a threaded portion of the anchor bolt inserted therein.

27 Claims, 13 Drawing Figures

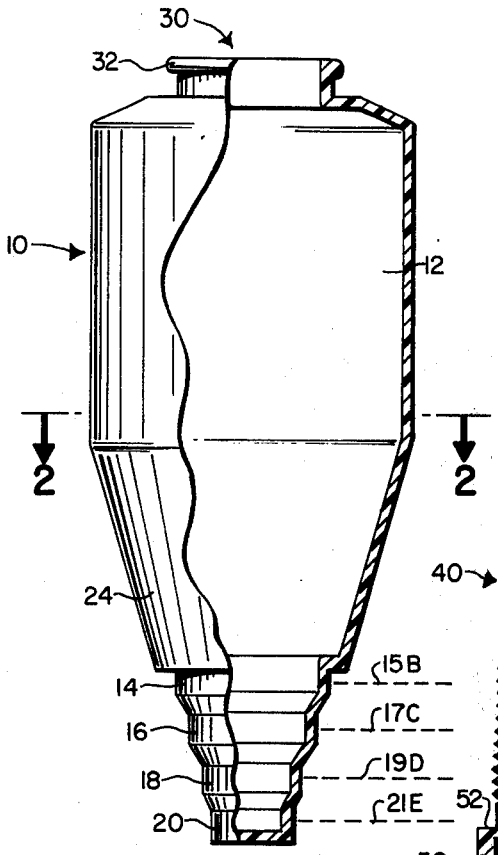
FIG. 1.
FIG. 2.
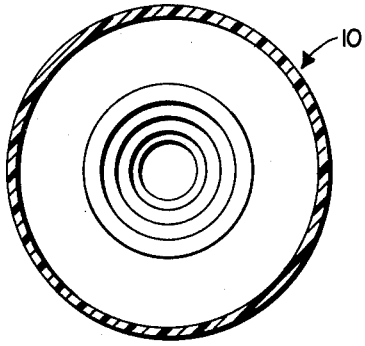
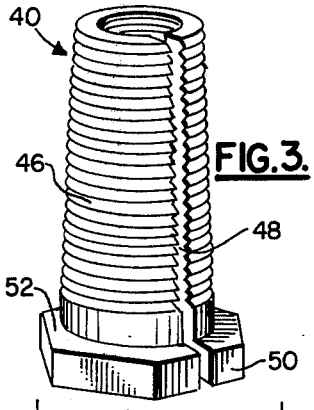
FIG. 3.
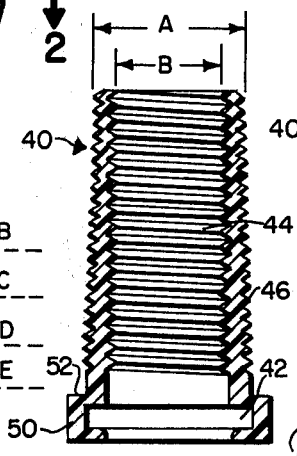
FIG. 4.
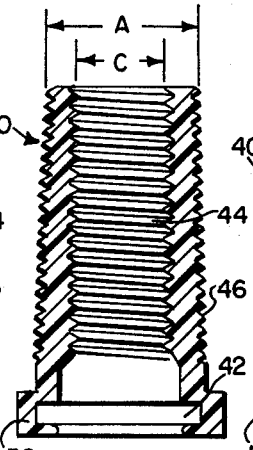
FIG. 4A.
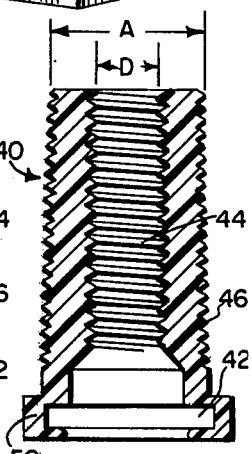
FIG. 4B.
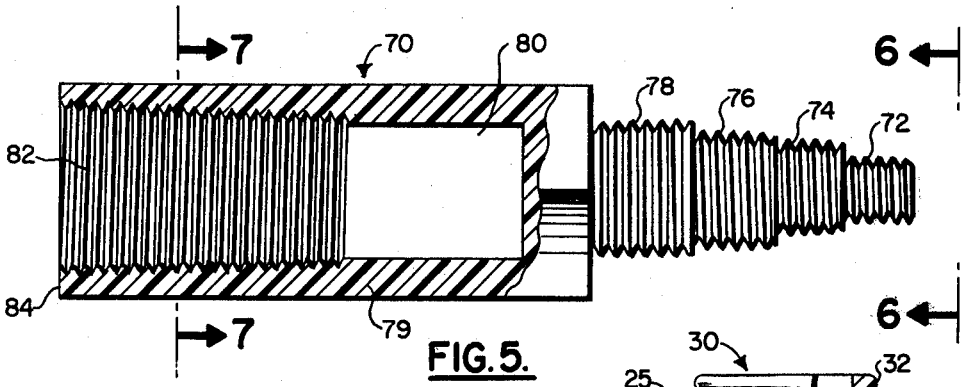
FIG. 5.
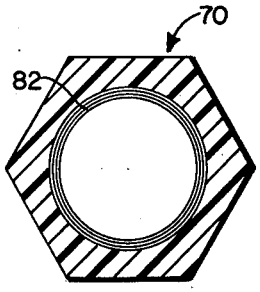
FIG. 7.
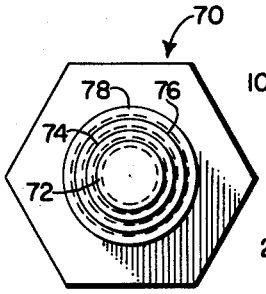
FIG. 6.
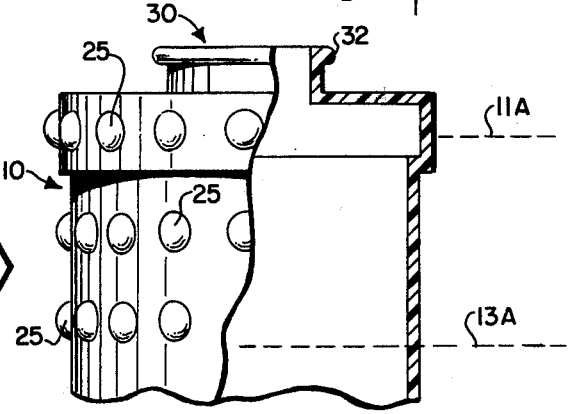
FIG. 1A.

ANCHOR BOLT THREAD PROTECTOR AND SLEEVE SYSTEM

This invention relates to a system for securing, protecting and enabling the adjustment of an anchor bolt in a body of concrete or the like.

BACKGROUND

Anchor bolts are widely used for the purpose of fastening machinery, process equipment, storage vessels, lamp posts, railings, columns, and other such items to suitable foundations, such as poured concrete. Installation of anchor bolts is commonly practiced by suspending them in position from a frame or template supported at about the level of the foundation to be poured and holding them in this position during the pouring and curing of the concrete. In this operation the anchor bolts are affixed to the template with their threaded ends extending upwardly through properly positioned holes in the template, a nut and, if necessary, a washer effecting the attachment.

While workable, the foregoing method of attachment leaves much to be desired. In the first place since it is not uncommon to have two to three inches of threads exposed above the top of the nut, a fair amount of time and effort is necessarily expended in applying and, subsequently, in removing the nut. In addition, in the pouring and distribution of the concrete, wet concrete is frequently splashed on the exposed threads. Compounding this problem is the ever-present tendency for the exposed threads to become rusty, especially in open-air installations. When these things happen it is often necessary to clean the exposed threads with a wire brush in order to back off the nut. Further, the exposed threads are susceptible to damage if accidently struck by objects being moved on or over the cured foundation prior to removal of the nut and the template.

In my U.S. Pat. No. 3,854,371 I have described an anchor bolt protective cap which overcomes the foregoing difficulties.

In order to permit adjustment of the position of the anchor bolt relative to the hardened concrete so that the bolt may be placed in proper registry with the cooperating holes in the base of the object to be fastened, it has been proposed heretofore to use anchor bolt sleeves or shields which furnish a void space around the shank of the anchor bolt. U.S. Pat. Nos. 3,430,408 and 3,500,607 are illustrative of such devices.

Published Netherlands patent application No. 6,809,623 describes a device for the removable connection of an anchor bolt and a form. A sleeve and a protective fastening part are employed.

SUMMARY OF THE INVENTION

This invention provides a system in which the advantages of an anchor bolt protective cap (e.g., see U.S. Pat. No. 3,854,371) and of an anchor bolt sleeve (e.g., see U.S. Pat. Nos. 3,430,408 and 3,500,607) can be realized concurrently in an efficient and economical manner. In addition this invention makes it possible to provide sleeves which can be readily used with anchor bolts of various sizes—it is not necessary to provide sleeves sized to fit anchor bolts of individual given diameters as was often the case heretofore.

In accordance with this invention the system comprises a sleeve adapted to be fitted onto and to provide a void space around a segment of the intermediate length of the anchor bolt; a hollow, generally cylindrical connecting member detachably attachable to the upper end of said sleeve and having a radially inwardly deformable portion; and a fastening member having a generally cylindrical hollow interior adapted to fit around and engage said connecting member and to cause the radially deformable portion of said connecting member to deform inwardly to effect gripping engagement between a portion of the interior of said connecting member and a threaded portion of the anchor bolt inserted therein. In use the engagement between the fastening member and the connecting member is such that not only is the foregoing inward deformation effected but in addition the fastening member becomes detachably attached to the connecting member so that the fastening member is able to hold the connecting member in fixed position relative to the template on which the fastening member rests. Consequently, the connecting member which grips and supports both the anchor bolt and the sleeve is itself held in position in an aperture or hole in the template by the fastening member which rests upon the template above this aperture or hole. Thus the system is held in the proper position during the pouring and setting of the concrete, and the sleeve furnishes the desired void space about the anchor bolt shank to make possible subsequent minor lateral adjustment should this be necessary in order to achieve proper registry with the object being fastened.

In addition to serving the gripping and positioning functions noted above, the fastening member concurrently affords protection to the threads of the anchor bolt. By fitting around and covering the connecting member, the fastening member also encases and covers the upper end of the threaded anchor bolt as well. Thus the threads are protected against splashing concrete, excessive rust formation, and physical damage due to accidental impacts or the like.

In preferred form, the connecting member is further characterized by having (i) a bore with thread gripping means therein, said bore in relaxed condition being sized to loosely encase the threaded portion of the anchor bolt; and (ii) a longitudinally slotted sidewall in which the slot extends along at least a portion of its length and is of sufficient width to enable, upon application of an annular force upon the exterior of the sidewall, enough radially inward flexing of the connecting member to cause said thread gripping means to grip at least a segment of the threaded portion of the anchor bolt encased in the bore. In addition to these features it is further preferred that the connecting member have a sidewall with a tapered exterior portion upwardly decreasing in diameter adapted to receive this annular force. In a more preferred form the tapered exterior is threaded.

A preferred sleeve construction is one in which the sleeve has at its lower end a plurality of axially aligned stepped hollow annular segments sized to receive in the respective bores thereof anchor bolts of different diameters, in each case the diameter of the bore in a given segment being larger than the diameter of the bore of the next lower segment. In addition to these features it is further preferred that the sleeve have, above these stepped annular segments, a generally frustoconical sidewall portion whereby the void space therein becomes larger in an upward direction. In its most preferred form the sleeve also has external protuberances adapted to extend into the concrete or the like, or conversely, has external depressions or "dimples" adapted to create and receive protuberances in the set concrete.

In either case such external surface irregularities greatly lessen the likelihood of the sleeve pulling out of or rotating in the set concrete.

In preferred form the sidewall defining the hollow interior of the fastening member has a taper upwardly decreasing in diameter for applying radial force upon the connecting member to cause the same to undergo the radially inward deformation. Preferably this interior sidewall of the fastening member is threaded. Further preferred features include fastening members in which the upper end has a threaded stud sized to carry at least one nut to be used in the anchor bolt, and especially fastening members in which the upper end has a plurality of axially aligned stepped threaded stud segments each sized to carry a different sized nut for an anchor bolt, in each case the diameter of a given segment being smaller than the diameter of the next lower segment.

A further highly preferred embodiment of this invention involves a device adapted to grip and support an anchor bolt sleeve and an anchor bolt in preselected position in a body of wet concrete or the like—which device is often referred to herein as the connecting member—which comprises a generally cylindrical body having a bore extending axially therethrough, an upper portion, a lower portion, and a longitudinally slotted sidewall; said bore having thread gripping means therein and being sized to loosely encase the threaded portion of an anchor bolt, the exterior of said upper portion having a taper upwardly decreasing in diameter, the interior of said lower portion having holding means therein to grip the upper portion of an anchor bolt sleeve so as to hold it in position to create a void space around a segment of an anchor bolt extending therethrough, said body being capable of radially inward flexing upon application of an annular force around the exterior of said upper portion, the width of the slot in said slotted sidewall in relaxed condition being sufficient to enable, upon application of such annular force, enough radially inward flexing of the body so that said gripping means are tightened about a threaded portion of an anchor bolt extending upwardly beyond the upper portion of the anchor bolt sleeve. These thread gripping means are preferably threads sized to generally correspond to the thread size of the anchor bolt to be received therein. The holding means which cooperates with the anchor bolt sleeve is preferably an annular recess adapted to receive and engage an annular head or rim suitably positioned on the upper exterior of the sleeve so that these two members can be detachably secured together in snap-fastening arrangement.

BRIEF DESCRIPTION OF THE FIGURES

In the Drawings are depicted illustrative preferred embodiments of this invention which, of course, may be modified in accordance with the spirit and scope of this invention as herein set forth and claimed. In the drawings, in which like numerals represent like parts among the several views:

FIG. 1 is an elevation, partly cut away, of a sleeve of this invention; the cut away portion showing the sleeve in vertical section;

FIG. 1A is an elevation, partly cut away, of part of the upper portion of another sleeve of this invention;

FIG. 2 is a section of FIG. 1 taken along line 2—2 thereof;

FIG. 3 is an elevation in perspective of a connecting member of this invention;

FIGS. 4, 4A, and 4B show in vertical section three different connecting members of this invention, these differing in the bore sizes of their respective upper portions;

FIG. 5 is an elevation, partly cut away, of a fastening member of this invention, the cut away portion showing the member in vertical section;

FIG. 6 is the exterior of FIG. 5 viewed along line 6—6 thereof;

FIG. 7 is a section of FIG. 5 taken along line 7—7 thereof;

DESCRIPTION OF PREFERRED EMBODIMENTS

Figure 8:
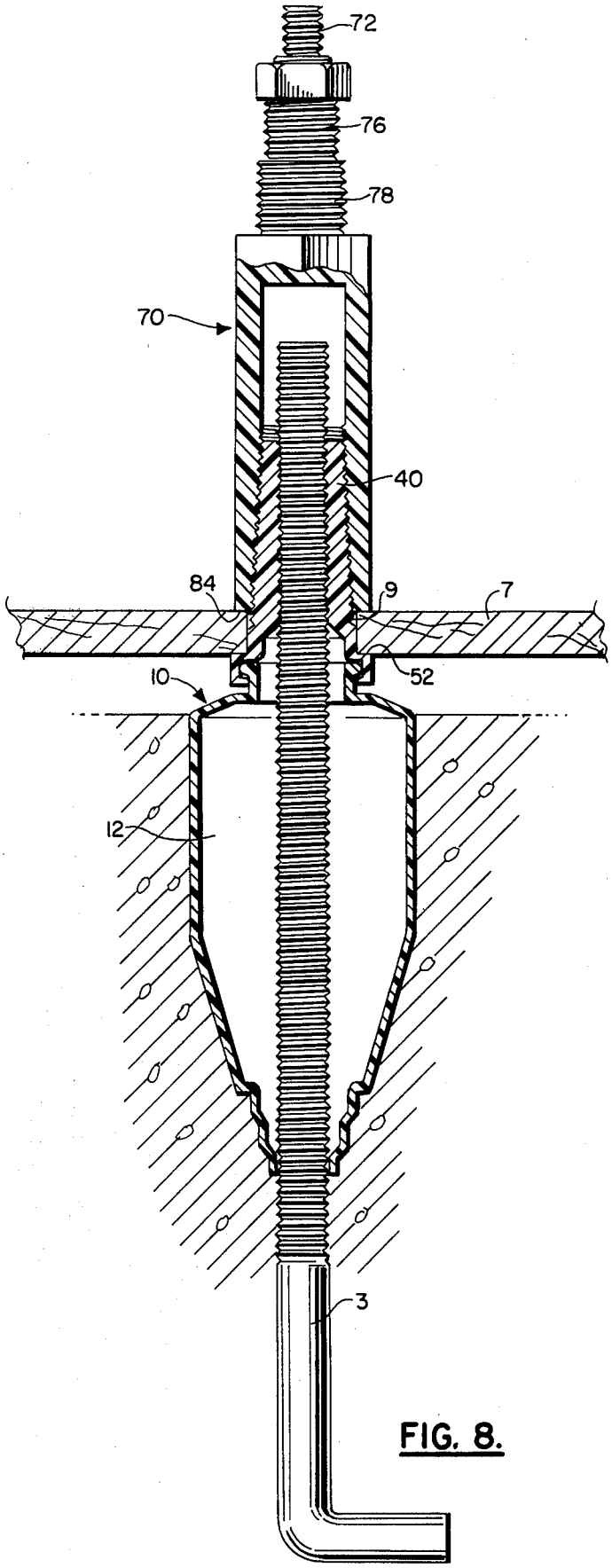
FIG. 8 is an elevation, partly cut away, of an assembled system of this invention in use with an anchor bolt, a body of concrete, and a template, the cut away portions showing parts in vertical section.

In the embodiments shown in the Figures, the overall system is basically composed of three members, namely sleeve 10, connecting member 40 and fastening member 70 which work in concert with each other, and with anchor bolt 3 and template 7 in effecting the advantageous results of this invention. In the form depicted, sleeve 10 is generally circular in cross-section with a radius large enough to provide a void space 12 along a segment of the anchor bolt 3. A series of axially aligned stepped hollow annular segments 14, 16, 18, 20 are provided at the bottom or lower end of sleeve 10. The bores of these respective segments are sized to accommodate anchor bolts of different standard sizes, such as, for example, anchor bolts with diameters of 1¼ inch, 1⅛ inch, 1 inch, and ¾ inch. Thus the diameter of the bore in segment 14 is larger than the diameter of the bore in segment 16 which in turn is larger than the diameter of the bore in segment 18, the diameter of the bore in segment 20 being the smallest of all—i.e., in each case the diameter of the bore in a given segment is larger than the diameter of the bore of the next lower segment. In this way it is possibly by cutting sleeve 10 along 15B, 17C, 19D or 21E to provide a bottom opening or aperture sized to fit or match with the diameter of the anchor bolt being utilized and thereby maintain the integrity of void space 12 by providing a connection through which an excessive amount of wet concrete cannot pass. The upper end of sleeve 10 has an axially positioned opening 30 sized to receive anchor bolts having any of the diameters provided for in segments 14, 16, 18 and 20. Around the upper and outer periphery of the wall defining opening 30 there is an annular rim or bead 32 adapted to form a snap-fit with a correspondingly sized annular recess 42 in connecting member 40. Although the configuration of sleeve 10 is susceptible to considerable variation and is thus largely a matter of choice, it is desirable that the lower portion of the sidewall have a section 24 with a frusto-conical configuration positioned above segments 14, 16, 18, 20 so that void 12 increases in diameter in an upward direction for at least a portion of its vertical distance as this minimizes the amount of grout or other filler required to fill the void space in the event a lateral adjustment of the encased anchor bolt becomes necessary. As indicated in FIG. 1A, protuberances 25 of any suitable configuration are preferably provided on the exterior of sleeve 10 to help insure that the sleeve will be snugly embedded in the cured concrete.

The sleeve depicted in FIG. 1A illustrates one form of protuberances 25 which are preferably present on the external surfaces of the sleeve to help insure that the sleeve will not rotate in or pull out of the set concrete. In addition FIG. 1A depicts an embodiment in which the sleeve may be shortened before use by the simple expedience of cutting the sleeve at two places with a knife, saw, or other suitable cutting tool. Thus in instances where a shorter sleeve is desired, a sleeve of the type shown in FIG. 1A is cut into three pieces, the two cuts being made at 11A and 13A. The intermediate cylindrical section (between 11A and 13A) is discarded, and the uppermost portion (the part above 11A) is pressed down over the lowermost portion (the part below 13A) thereby reforming a shorter sleeve. If desired an adhesive or a heat seal may be used to strengthen the so united parts.

Connecting member 40 in the form depicted has a generally cylindrical threaded interior bore 44 sized when in relaxed condition to loosely encase the threaded portion of anchor bolt 3. The upper exterior portion 46 of connecting member 40 is also threaded and the wall defining portion 46 is tapered so that the exterior diameter of the connecting member progressively decreases in an upward direction along exterior portion 46. A slot 48 extends along at least a substantial portion of the length of the wall defining portion 46 and in the form depicted, along the entire length of connecting member 40. The lower portion 50 of connecting member 40 is composed of a section or segment of increased diameter as compared to portion 46. The upper surface of lower portion 50 is in the form of an annular shoulder 52 of sufficient radial size to fit below an oversized hole or aperture 9 in template 7—note especially FIG. 8 in this connection. As noted above, the lower interior of portion 50 is provided with annular recess 42 which is sized to snap onto head 32 of sleeve 10 and thereby provide detachable coaxial attachment between connecting member 40 and sleeve 10.

Fastening member 70 in the form depicted is a generally tubular body which is open at its lower end and closed at its upper end. On its upper end fastening member 70 has a group of axially aligned stepped threaded stud segments 72, 74, 76, 78 each sized to carry a different sized nut for one of several anchor bolts of different standard sizes, such as, for example, the nuts used with anchor bolts with diameters of ¾ inch, 1 inch, 1⅛ inch, and 1¼ inch. Thus the diameter of the lowermost segment 78 is larger than the diameter of segment 76 which in turn is larger than the diameter of segment 74 which in turn is larger than the diameter of the uppermost segment 72—i.e., in each case the diameter of a given segment is smaller than the diameter of the next lower segment. This enables any one of a plurality of different standard sized nuts to be secured on the proper sized stud segment of fastening member 70 and thereby provide a temporary place for storing the nut to be used with the anchor bolt with which the sleeve, connecting member, and fastening member are being employed. Thus the nut will remain readily available for subsequent use in anchoring the object to the finished foundation and as a consequence the system composed of sleeve 10, connecting member 40, and fastening member 70 serves as a temporary connecting link between the anchor bolt and the nut. It is of course desirable therefore that the sizes of the various stud segments 72, 74, 76 and 78 correspond to the bore sizes of the various annular segments 20, 18, 16, and 14 respectively. It will of course be evident that any reasonable number of stud segments and corresponding number of annular segments can be employed in designing the fastening member and the sleeve.

In the fastening member 70 the lower portion of the sidewall 79 defining the hollow interior 80 of member 70 has a taper upwardly decreasing in diameter. This tapered interior surface 82 is preferably threaded or otherwise provided with suitable protuberances or surface undulations to enable tapered surface 82 to be brought into detachable attachable engagement with the upper exterior portion 46 of connecting member 40. Most preferable the taper of tapered surface 82 corresponds in general configuration but is somewhat smaller in diameter than the taper of exterior portion 46 so that by pressing and rotating fastening member 70 onto connecting member 40 sufficient radial force is transmitted from tapered surface 82 to tapered upper exterior portion 46 to cause connecting member 40 to undergo inward radial deformation. In this way fastening member 70 not only becomes detachably attached to connecting member 40 but also causes the threaded interior bore 44 of connecting member 40 to tightly grip the threaded portion of anchor bolt 3. Contributing to the efficiency of this operation is the presence of slot 48 in connecting member 40. Upon application of this radial force to portion 46 slot 48 is caused to contract so that the threaded interior bore 44 is brought into intimate contact with the threaded portion of anchor bolt 3.

As can be seen from FIG. 8 the radial girth or size of the base 84 of fastening member 70 is sufficiently large as to enable the fastening member to rest on or over the surface of template 7 about the oversized hole or aperture 9 therein.

As indicated in FIGS. 4, 4A, and 4B, it is convenient to provide a supply of different sized connecting members 40 to be used with correspondingly different sized anchor bolts, such as, for example, connecting members with internal bores of 1 inch, 1⅛ inch, and 1¼ inch for use with the correspondingly-sized anchor bolts. Thus while the tapering external diameter "A" and shape of such different sized connecting members are preferably the same in all cases, they differ from each other in wall thickness in their respective upper portions 46 so that they have different bore sizes "B", "C", and "D". On the other hand it is possible to furnish connecting members with a suitably sized slot 48 and having sufficient inward flexibility upon application of the annular force from fastening member 70 as to be useful with anchor bolts of different diameters, particularly where the diameters vary within a reasonably narrow range.

In using the system depicted in the Figures, sleeve 10—cut along 15B, 17C, 19D, or 21E to accommodate the size of the anchor bolt 3 selected—is positioned on the bolt at a suitable place intermediate its length so that its threaded portion extends upwardly beyond opening 30. An appropriately sized connecting member 40 is snapped onto upper end of sleeve 10 through engagement between bead 32 and annular recess 42. This connection may be effected either before or after the positioning of sleeve 10 on bolt 3, but in either event, the combination of sleeve 10 and connecting member 40 is positioned on bolt 3 so that at least some of its threaded portion is in position to be engaged by interior bore 44. These parts are inserted upwardly through a suitable-sized aperture 9 in the template 7 so that the sleeved bolt is in the desired position relative to the template and the surface of the concrete base to be formed (Note FIG. 8). Thereupon fastening member 70 is affixed to the upper portion of the connecting member and sufficient radial pressure is applied thereto so that when base 84 of the connecting member is allowed to rest on the surface of template 7 around aperture 9 such as shown in FIG. 8, the combination of the bolt, the sleeve and the connecting member all are held in place by the grip between interior bore 44 and at least a part of the threaded portion of bolt 3. By providing threads on the exterior 46 of connecting member 40 and on the interior tapered surface 82 of fastening member 70 in accordance with the preferred embodiment depicted in the Figures, appropriate relative rotation between member 70 and connecting member 40 draws these two members toward each other so that annular shoulder 52 and base 84 grip opposite sides of template 7 and thereby lessening the likelihood of undesired lateral movement of the parts within the oversized aperture 9. The nut for use with the anchor bolt can be applied to the suitably-sized stud 72, 74, 76, 78 at any convenient time. Once the parts are in proper alignment and position, such as depicted in FIG. 8, the concrete is poured and allowed to cure. After the concrete has set, fastening member 70 is removed and after removal of the template, connecting member 40 is detached from sleeve 10 and removed. The detachment of connecting member 40 from sleeve 10 is facilitated by the presence of slot 48 as this enables the connecting member to be readily pried away by insertion of screwdriver or other similar tool into the slot and application of a force tending to spread or increase the width of the slot so that annular recess 42 is disengaged and taken off of bead 32. Thus slot 48 of the preferred connecting members of this invention serves a dual function of enhancing the gripping between interior bore 44 and the threads on the anchor bolt and of facilitating removal of the connecting member from the sleeve. Moreover, slot 48 also facilitates attachment of the connecting member to the sleeve at the outset.

Figure 9:
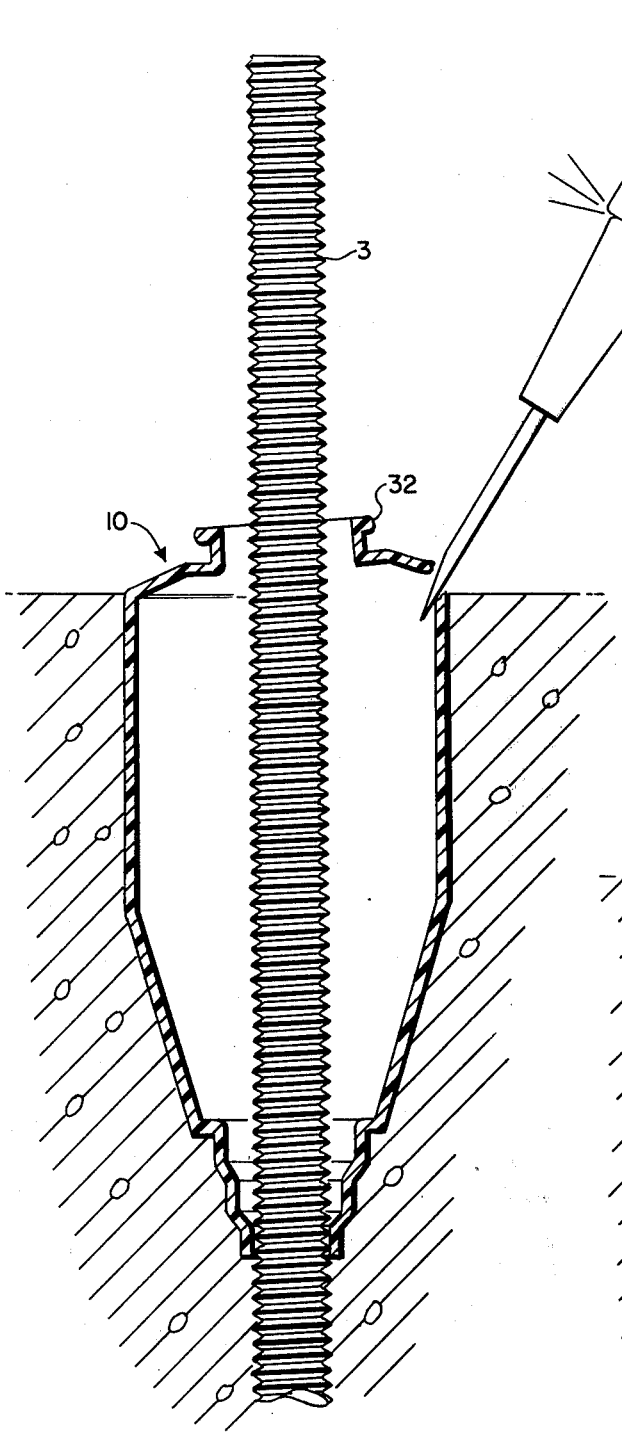
FIG. 9 illustrates the removal of the upper portion of the sleeve after the concrete has set and the other parts shown in FIG. 8 have been removed.

Next the upper portion of the sleeve is cut away with a knife or chisel (note FIG. 9) and the void space 12 is filled with grout, wet concrete, or the like. If there is proper registry between the anchor bolts and the object to be fastened to the cured foundation, the object is secured in the desired position using the nuts temporarily affixed to the fastening members.

Figure 10:
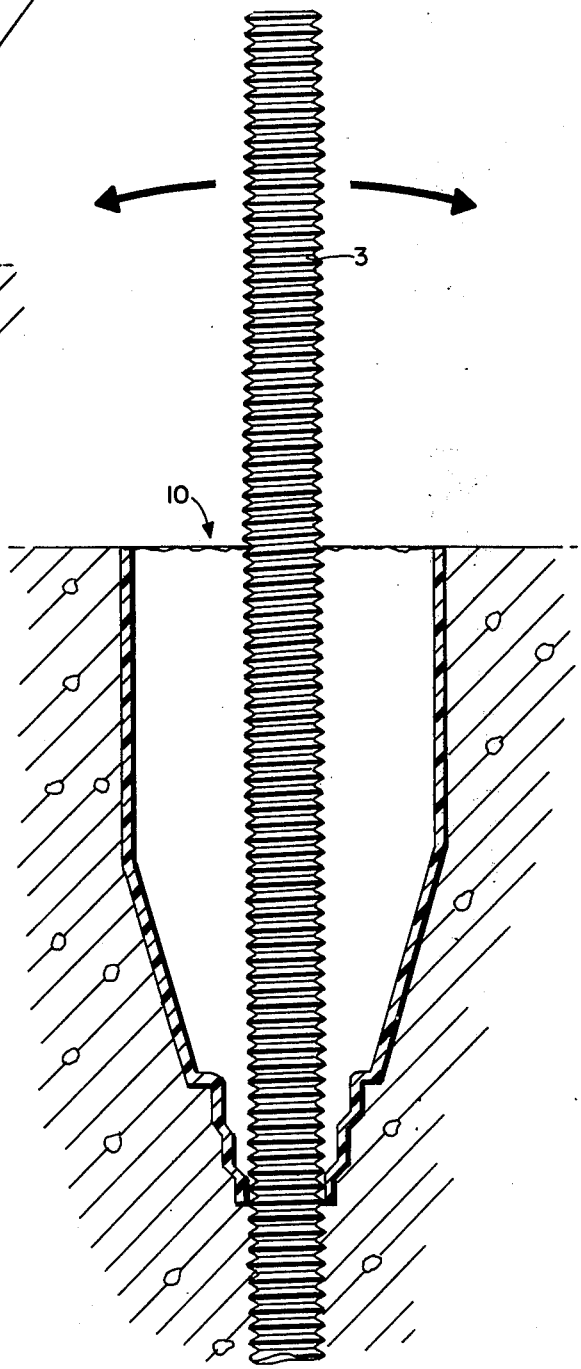
FIG. 10 illustrates lateral adjustment of the sleeved anchor bolt in the set concrete.

If, on the other hand, it is found that some lateral adjustment of one or more anchor bolts is needed in order to achieve the proper registry with the object to be fastened to the cured foundation, the shaft of the anchor bolt is aligned (note FIG. 10) so that it is brought into the desired position. The void space 12 is filled with grout, wet concrete, or other suitable material and the object is fastened in place using the nuts kept readily available by virtue of having been affixed to the appropriately sized stud 72, 74, 76 or 78 on the fastening members.

It will be evident from the preceding discussion that the connecting members of this invention are yieldable in the sense that application of a suitable constrictive force will cause sufficient constriction or inward radial deformation to enable the interior portion of the wall to tightly grip the shank of the threaded member encased by the connecting member. Accordingly, the connecting members of this invention may be prepared from a variety of materials having these yieldable characteristics, e.g., certain relatively flexible metals or metal alloys, certain relatively hard but flexible metals or metal alloys, certain relatively hard but flexible rubbers or elastomers, and the like. Particularly preferred materials for use in preparing the connecting members of this invention are resins or plastics which have the requisite yieldability or deformation characteristics. For this purpose use may be made of such plastics as polyesters, nylons, styrene acrylonitrile copolymers (SAN), acrylonitrile butadiene styrene terpolymers (ABS), plasticized polyvinyl chloride, polyethylene (especially medium and high density polyethylenes), polypropylene, polyphenylene oxides, polyacetals, cellulose acetate-butyrate, and various other resins or plastics. These and similar engineering-type plastics can be readily shaped or molded into the desired form and they will retain this form under normal service conditions. At the same time materials of this type are sufficiently yieldable to permit enough radial deformation under application of pressure so that the device can function as described herein without breaking. If desired the plastics or resins may be, in accordance with known practices, plasticized and/or they may be filled with suitable fillers or reinforced with fibers, whiskers, or other materials commonly used for this purpose.

By the same token, it is convenient to mold the sleeve and the fastening member from the same types of materials, especially plastics such as rigid polyethylene or the like. Plastics of this type are particularly desirable for use in making the sleeves since they are readily cut with a knife and thus are highly suitable where it is desired to cut away the upper portion in connection with the making of a lateral adjustment of the anchor bolt as described above. Moreover such plastics are relatively inexpensive and methods for using them in molding operations are well established in the trade.

If desired, paint or dye may be applied to or incorporated in the fastening members so that they can be more readily seen in dimly lit areas. Fluorescent or bright colors are particularly desirable as this increases their visibility and renders it less likely that persons walking in the vicinity of the protected and secured anchor bolts will trip over the upwardly extending objects.

While the system of this invention has been shown in the form of three individual unitary structures (sleeve, connecting member, fastening member), any or all of these may be formed of mating, snap-together sections each formed with conventional, registrable snap-fastening means associated with the abutting edge portions of mating sections. Similarly, cross-section configurations, shapes and relative sizes of the several structures of the system may be widely varied so long as the proper functioning of the system as described herein is not unduly impaired.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An assembly for securing, protecting and enabling adjustment of an anchor bolt in a body of concrete or the like which comprises the combination of:

(a) a sleeve open at both ends which fits onto and provides a void space around a segment of the intermediate length of the anchor bolt, said sleeve having connecting means exteriorly positioned in proximity to its upper end;

(b) a hollow, generally cylindrical connecting member open at both ends and having interiorly positioned connecting means in proximity to its lower end interconnectable with said exteriorly positioned connecting means of the sleeve to effect detachable attachment between the connecting member and the sleeve, said connecting member additionally having a radially inwardly deformable portion; and (c) a hollow tubular fastening member open at its lower end and closed at its upper end and having a generally cylindrical hollow interior sized and shaped to fit around and securely engage an exterior portion of said connecting member, the internal diameter of a lower interior portion of said fastening member being undersized relative to the external diameter of an exterior portion of said connecting member so that when said fastening member is fitted onto said connecting member said lower interior portion engages said exterior portion and causes the radially deformable portion of said connecting member to deform inwardly to effect gripping engagement between a portion of the interior of said connecting member and a threaded portion of the anchor bolt inserted therein.

2. A combination according to claim 1 characterized in that the upper end of said fastening member has a plurality of axially aligned stepped threaded stud segments each sized to carry a different sized nut for an anchor bolt, in each case the diameter of a given segment being smaller than the diameter of the next lower segment, and in that said sleeve has at its lower end a plurality of axially aligned stepped hollow annular segments sized to receive in the respective bores thereof anchor bolts of different diameters, in each case the diameter of the bore in a given segment being larger than the diameter of the bore of the next lower segment.

3. A combination according to claim 1 further characterized in that the sidewall defining the hollow interior of said fastening member has a taper upwardly decreasing in diameter for applying radial force upon the connecting member to cause the same to undergo the radially inward deformation.

4. A combination according to claim 1 wherein said connecting member is further characterized by having (i) a bore with thread gripping means therein, said bore in relaxed condition being sized to loosely encase the threaded portion of the anchor bolt; and (ii) a longitudinally slotted sidewall in which the slot extends along at least a portion of its length and is of sufficient width to enable, upon application of an annular force upon the exterior of the sidewall, enough radially inward flexing of the connecting member to cause said thread gripping means to grip at least a segment of the threaded portion of the anchor bolt encased in the bore.

5. A combination according to claim 4 wherein said connecting member is still further characterized in that said sidewall has a tapered exterior portion upwardly decreasing in diameter adapted to receive said annular force.

6. A combination according to claim 5 wherein said tapered exterior portion is threaded.

7. A combination according to claim 1 wherein said sleeve is further characterized by having at its lower end a plurality of axially aligned stepped hollow annular segments sized to receive in the respective bores thereof anchor bolts of different diameters, in each case the diameter of the bore in a given segment being larger than the diameter of the bore of the next lower segment.

8. A combination according to claim 5 wherein said connecting means comprise an annular radially-projecting bead and an annular groove adapted to receive said bead.

9. A combination according to claim 7 wherein said sleeve has, above said stepped annular segments, a generally frustoconical sidewall portion whereby the void space therein becomes larger in an upward direction.

10. A combination according to claim 9 wherein said sleeve has external protuberances adapted to extend into the concrete or the like.

11. A combination according to claim 1 further characterized in that the sidewall defining the hollow interior of said fastening member is threaded.

12. A combination according to claim 11 still further characterized in that the upper end of said fastening member has a threaded stud sized to carry at least one nut to be used on the anchor bolt.

13. A combination according to claim 11 still further characterized in that the upper end of said fastening member has a plurality of axially aligned stepped threaded stud segments each sized to carry a different sized nut for an anchor bolt, in each case the diameter of a given segment being smaller than the diameter of the next lower segment.

14. A device adapted to grip and support an anchor bolt sleeve and an anchor bolt in preselected position in a body of wet concrete or the like, said device comprising a generally cylindrical hollow tubular body characterized in that (a) the body has a bore extending axially therethrough so that the body is open at both ends;

(b) said bore is defined by a sidewall having on only one side of the body one longitudinal slot extending the full length of the body;

(c) said bore is sized to loosely encase the threaded portion of an anchor bolt and has thread gripping means therein;

(d) said sidewall has an exteriorly tapered upper portion wherein the taper upwardly decreases in diameter;

(e) said sidewall has at its lower exterior portion a radially projecting flanged portion;

(f) said sidewall has at its lower interior portion below said thread gripping means annular holding means to interconnect with and grip interconnectable annular holding means on the upper exterior portion of an anchor bolt sleeve so as to hold it in position to create void space around a segment of an anchor bolt extending therethrough;

(g) said longitudinal slot extends radially clear through the entire one side of said body including said sidewall, said flanged portion and said annular holding means;

(h) said body is capable of radially inward flexing upon application of an annular force around the exterior of said upper portion; and (i) the width of said slot in relaxed condition is sufficient to enable, upon application of such annular force, enough radially inward flexing of the body so that said thread gripping means are tightened about a threaded portion of an anchor bolt extending upwardly beyond the upper portion of the anchor bolt sleeve.

15. A device according to claim 14 wherein said thread gripping means are threads.

16. A device according to claim 14 wherein said body is made from yieldable plastic material.

17. A device according to claim 14 wherein said body is made from yieldable plastic material, said thread gripping means are threads, and said exteriorly tapered portion of said body is threaded.

18. A device according to claim 14 wherein said holding means is an annular recess adapted to receive and engage an annular radially projecting rim.

19. A device according to claim 14 wherein the exteriorly tapered upper portion of said body is threaded.

20. In combination, a device according to claim 19 and a tubular fastening member having a threaded tapered hollow interior conforming to and applying annular force around the threaded exteriorly tapered upper portion of the device of claim 19.

21. In combination (a) a device according to claim 19;

(b) a tubular fastening member having a threaded tapered hollow interior conforming to and applying annular force around the threaded exteriorly tapered upper portion of the device of claim 19; and (c) an anchor bolt sleeve (i) having a hollow body adapted to be fitted onto and to provide a void space around a segment of the intermediate length of an anchor bolt, and (ii) having on its upper exterior portion annular holding means interconnectable with the annular holding means of the device of claim 19 to effect detachable attachment between said device and said sleeve.

22. In combination, a device according to claim 14 and an anchor bolt sleeve comprising an axially elongated hollow body having an internal diameter sufficient to provide a substantial void space around an elongated segment of the intermediate length of an anchor bolt coaxially aligned therein, said body having at its upper end an axially aligned reduced diameter hollow upstanding neck portion the internal diameter of which is at least large enough to accommodate an anchor bolt, said body having at its lower end an axially aligned reduced diameter hollow portion the internal diameter of at least a portion of which substantially corresponds to the diameter of an anchor bolt, said sleeve having in proximity to the upper end of said upstanding portion exteriorly positioned annular holding means interconnectable with the annular holding means of the device of claim 14 to effect detachable attachment between said device and said sleeve whereby said sleeve is coaxially aligned with and extends beyond the lower end of said device of claim 14.

23. The combination of claim 22 further characterized in that the body of said anchor bolt sleeve has axially aligned at its lower end a plurality of stepped hollow annular segments sized to receive in the respective bores thereof anchor bolts of different diameters, in each case the diameter of the bore in a given segment being larger than the diameter of the bore of the next lower segment.

24. An anchor bolt sleeve characterized in that (a) it comprises an axially elongated hollow body having an upstanding wall portion, said body having an internal diameter sufficient to provide a substantial void space around an elongated segment of the intermediate length of an anchor bolt axially aligned therein;

(b) said body has at its upper end an axially aligned reduced diameter hollow cylindrical upstanding neck portion, the internal diameter of which is smaller than the internal diameter of said hollow body;

(c) the upper exterior of said neck portion has an annular bead projecting radially therefrom for effecting detachable attachment with a device having an annular groove interconnectable therewith;

(d) said body has at its upper end an annular shoulder wall portion connecting the top of said upstanding wall portion to said upstanding neck portion at a locus below and spaced apart from said annular bead; said shoulder wall portion being severable from said body so that said shoulder wall portion and said upstanding neck portion can be removed from said body to expose said void space;

(e) said body has at its lower end a plurality of axially aligned stepped hollow cylindrical segments sized to receive in the respective bores thereof anchor bolts of different diameters, in each case the diameter of the bore in a given segment being larger than the diameter of the bore of the next lower segment, said segments being severable from said body so that a bottom opening sized to match with the diameter of said anchor bolt can be formed by cutting across the appropriately-sized segment;

(f) the internal diameter of said upstanding neck portion is at least large enough to accommodate an anchor bolt whose diameter corresponds to the largest bore of said stepped hollow cylindrical segments; and (g) the void space around said segment has a volume large enough so that when said body and said anchor bolt are in suitable anchoring position in set concrete or the like and after removal of said shoulder wall portion and said upstanding neck portion from said body, the upper portion of the anchor bolt may be laterally adjusted to a position previously blocked by said shoulder wall portion and said upstanding neck portion.

25. A device according to claim 24 wherein the sleeve has, above said stepped hollow cylindrical segments, a generally frustoconical sidewall portion whereby the void space therein becomes larger in an upward direction.

26. A device according to claim 24 wherein said body has external protuberances adapted to extend into the concrete or the like.

27. A fastening member characterized in that it comprises a tubular body having an open end, a closed end and a generally cylindrical tapered hollow interior in which the taper commences at the open end and progressively decreases in diameter along its length; in that the sidewall defining said taper is threaded along its length; in that a plurality of axially aligned stepped threaded stud segments extend outwardly from the exterior of said closed end in the opposite direction from said open end, each segment sized to carry a different sized nut, in each case the diameter of a given segment being smaller than the diameter of the next more interiorly positioned segment; and in that the internal diameter of said tapered hollow interior at the open end is larger than the diameter of the largest of said stepped threaded stud segments.

* * * * *